US008715062B2

(12) United States Patent
Coutts

(10) Patent No.: US 8,715,062 B2
(45) Date of Patent: May 6, 2014

(54) METHOD AND ARTICLE OF MANUFACTURE FOR MAKING LOTTERY SELECTIONS

(76) Inventor: Daryl David Coutts, Edmonton (CA)

( * ) Notice: Subject to any disclaimer, the term of this patent is extended or adjusted under 35 U.S.C. 154(b) by 1305 days.

(21) Appl. No.: 11/984,554

(22) Filed: Nov. 20, 2007

(65) Prior Publication Data

US 2008/0132327 A1 Jun. 5, 2008

Related U.S. Application Data

(60) Provisional application No. 60/860,825, filed on Nov. 24, 2006.

(51) Int. Cl.
*A63F 9/24* (2006.01)

(52) U.S. Cl.
USPC ..... 463/22; 463/17; 463/31

(58) Field of Classification Search
USPC ..... 463/17, 22, 31
See application file for complete search history.

(56) References Cited

U.S. PATENT DOCUMENTS

| | | | | | |
|---|---|---|---|---|---|
| 4,692,863 | A * | 9/1987 | Moosz | 463/18 |
| 4,819,267 | A * | 4/1989 | Cargile et al. | 713/184 |
| 5,356,144 | A * | 10/1994 | Fitzpatrick et al. | 463/22 |
| 5,778,069 | A * | 7/1998 | Thomlinson et al. | 380/262 |
| 6,267,670 | B1 * | 7/2001 | Walker et al. | 463/17 |
| 6,554,710 | B1 * | 4/2003 | Olson | 463/42 |
| 6,811,484 | B2 * | 11/2004 | Katz et al. | 463/17 |
| 7,674,169 | B2 * | 3/2010 | Libby et al. | 463/17 |
| 2001/0036853 | A1 * | 11/2001 | Thomas | 463/17 |
| 2005/0050122 | A1 * | 3/2005 | Blumenthal et al. | 708/250 |

* cited by examiner

*Primary Examiner* — Steve Rowland

(57) ABSTRACT

Methods for generating a group of numbers usable for selections in a lottery are described. A user interface to a lottery selection method is also disclosed.

1 Claim, 4 Drawing Sheets

```
300    int[,] iGroupOfNums = new int[iNumberOfTickets, iBallsperTicket];
301    int[] iOccurrencesInGroupOfNums = new int[N + 1];
302    int S = N - iExcludes.Length;
303    Random myRandom = new Random();

304    for (int j = 0; j < iNumberOfTickets; j++)
       {
305        int[] iOccurrencesInTicket = new int[N + 1];
306        for (int k = 0; k < iBallsperTicket; k++)
           {
307                bool bPickAnotherNumber = false;

308                do
                   {
309                   bPickAnotherNumber = false;
310                   iGroupOfNums[j, k] = myRandom.Next(1, N + 1);
311                   if (iOccurrencesInTicket[iGroupOfNums[j, k]] > 0)
                      {
312                      bPickAnotherNumber = true;
                      }
313                   if (iOccurrencesInGroupOfNums[iGroupOfNums[j, k]] == 1 + (j * iBallsperTicket + k) / S)
                      {
314                      bPickAnotherNumber = true;
                      }
315                   for (int m = 0; m < iExcludes.Length; m++)
                      {
316                      if (iGroupOfNums[j, k] == iExcludes[m])
                         {
317                            bPickAnotherNumber = true;
                         }
                      }
318                }while (bPickAnotherNumber);

319                iOccurrencesInTicket[iGroupOfNums[j, k]]++;
320                iOccurrencesInGroupOfNums[iGroupOfNums[j, k]]++;
           }//k

       }//j
```

Fig. 3

170

| | | | | | | |
|---|---|---|---|---|---|---|
| 07 | 10 | 16 | 20 | 36 | 44 | |
| 08 | 23 | 25 | 40 | 43 | 46 | |
| 05 | 17 | 26 | 34 | 35 | 38 | |
| 11 | 13 | 18 | 28 | 32 | 41 | |
| 04 | 12 | 24 | 29 | 31 | 33 | |
| 06 | 14 | 27 | 37 | 39 | 45 | |
| 09 | 15 | 19 | 21 | 22 | 42 | |
| 06 | 12 | 22 | 23 | 31 | 32 | |

400

| 4 | 5 | 6 | 7 | 8 | 9 | 10 | 11 | 12 | 13 | 14 | 15 | 16 | 17 | 18 | 19 | 20 | 21 | 22 | 23 | 24 | 25 | 26 | 27 | 28 | 29 | 31 | 32 | 33 | 34 | 35 | 36 | 37 | 38 | 39 | 40 | 41 | 42 | 43 | 44 | 45 | 46 |
|---|---|---|---|---|---|---|---|---|---|---|---|---|---|---|---|---|---|---|---|---|---|---|---|---|---|---|---|---|---|---|---|---|---|---|---|---|---|---|---|---|---|
| 1 | 1 | 2 | 1 | 1 | 1 | 1 | 1 | 2 | 1 | 1 | 1 | 1 | 1 | 1 | 1 | 1 | 1 | 2 | 2 | 1 | 1 | 1 | 1 | 1 | 2 | 2 | 1 | 1 | 1 | 1 | 1 | 1 | 1 | 1 | 1 | 1 | 1 | 1 | 1 | 1 | 1 |

Fig. 4

METHOD AND ARTICLE OF MANUFACTURE FOR MAKING LOTTERY SELECTIONS

TECHNICAL FIELD

The invention relates to a method for making lottery selections comprising generating a group of numbers in such a way as to more evenly distribute numbers within the group of numbers than if the numbers were generated purely randomly.

BACKGROUND OF THE INVENTION

Many people play lotteries. Often lottery players who buy lottery tickets use the "quick pick" method, where the lottery machine generates each lottery entry independently and randomly. When a player buys multiple lottery tickets for the same draw using the "quick pick" method they are often disappointed to discover that they are circling only a few winning numbers across all of their entries. The reason for this is because the "quick pick" method generates each lottery selection independently, and unless a player buys a large number of lottery tickets, the distribution of numbers across a player's selections is uneven.

What is needed is a method that more evenly distributes the occurrences of each number across all of a player's lottery selections and yet still provides the convenience of the "quick pick" method. The player may not win more in the lottery, but at least they will enjoy the satisfaction of circling more winning numbers across all of their lottery selections.

Lottery players that actually choose their own numbers often eliminate the winning numbers from the previous lottery drawing in the belief that if the winning numbers just came up they cannot possibly be drawn again so soon. Lottery players also like to have numbers in their lottery selections that are associated with dates that are important to them, such as birthdays and anniversaries.

Also what is needed is the ability for lottery players to designate a set of numbers that can be excluded from their lottery selections. And further, lottery players need to be able to select a date that influences their lottery selections.

BRIEF SUMMARY OF THE INVENTION

A method of generating a group of numbers which is usable as selections for a lottery is presented. The method comprises obtaining a first set of numbers, receiving an indication to generate the group of numbers, generating the group of numbers and then displaying the group of numbers. The group of numbers that is generated excludes numbers belonging to the first set of numbers and the group of numbers has the characteristic that the difference between the number of occurrences of a first number in the group of numbers and the number of occurrences of a second number in the group of numbers is at most one.

Other objects, features and advantages of the present invention will become apparent upon perusal of the following description in conjunction with the appended drawings.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

FIG. 3 illustrates an exemplary snippet of programming code for implementing a process for generating numbers suitable for use as lottery selections.

FIG. 4 illustrates an exemplary occurrence array for a group of numbers.

DESCRIPTION OF EMBODIMENTS

Figure 1:
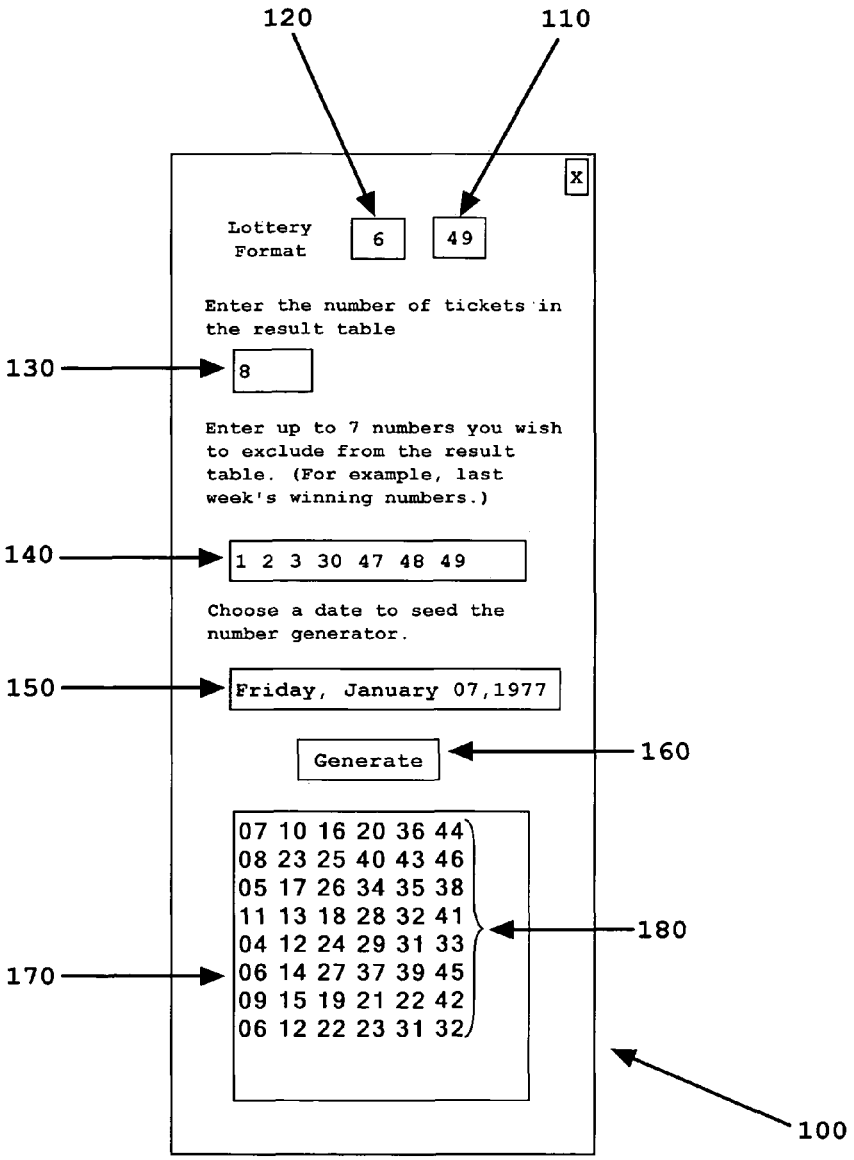
FIG. 1 illustrates an exemplary window of a graphical user interface to a process for generating numbers suitable for use as lottery selections.

FIG. 1 shows a window 100, the window 100 part of an exemplary embodiment of a graphical user interface to a process for generating a group of numbers 180 suitable for use as selections in a lottery. User interface element 110 and user interface element 120 allow a user to define a lottery format for which they want the group of numbers 180 generated. In the example of FIG. 1, the user has selected a lottery format corresponding to six balls being chosen from a population of forty-nine balls. User interface element 130 allows a user to specify a number of tickets for which they want the group of numbers 180 generated. User interface element 140 allows the user to specify a set of numbers that are to be excluded from the group of numbers 180 that are generated by the process. User interface element 150 allows a user to specify a date which can be used in the number generation process to influence the group of numbers 180. A user can click user interface element 160 to invoke the number generation process. User interface element 170 displays the group of numbers 180 generated by the process.

Figure 2:
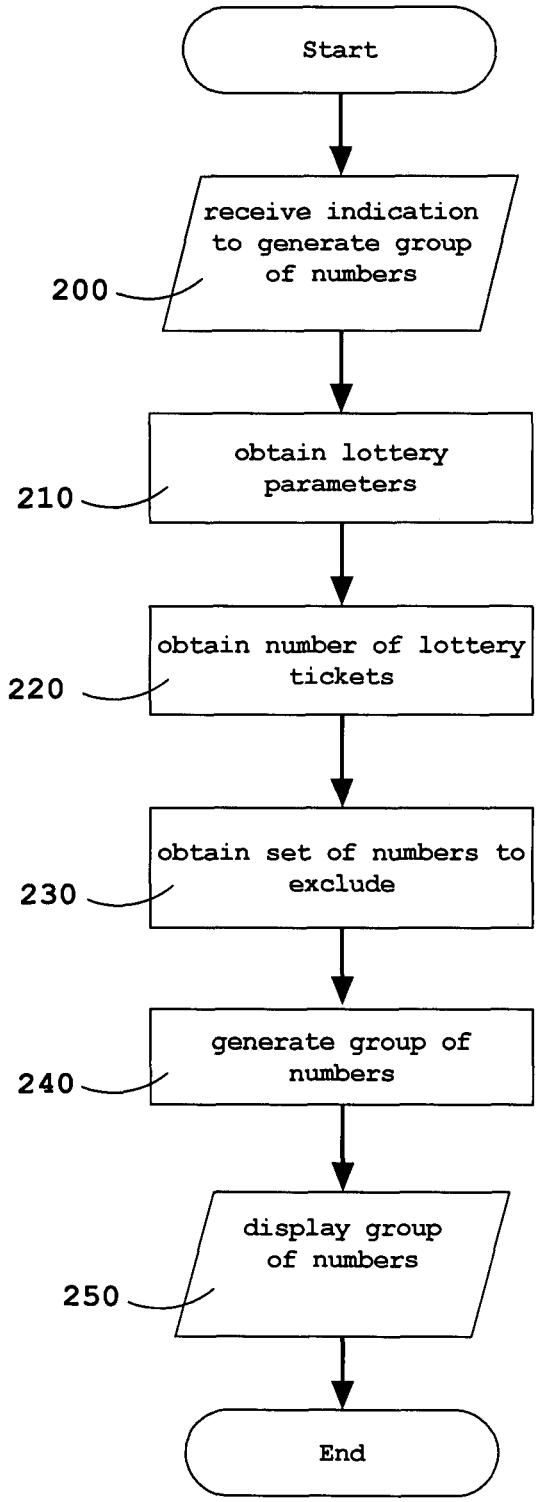
FIG. 2 illustrates a flowchart showing an exemplary process for generating numbers suitable for use as lottery selections.

FIG. 2 illustrates an exemplary flowchart of a process for generating a group of numbers 180 suitable for use as selections for a lottery. In block 200 the click event for user interface element 160 is monitored. When a user clicks the user interface element 160, the process continues at block 210. In block 210, the lottery parameters are obtained, the act of this block may correspond to obtaining the information from the user interface elements 110 and 120. In block 220, the number of tickets for which to generate the group of numbers 180 is obtained, the act of this block may correspond to obtaining the information from the user interface element 130. In block 230, the set of numbers to exclude from the group of numbers 180 is obtained. The act of block 220 may correspond to obtaining the information from user interface element 140. In block 240 the group of numbers 180 is generated, the details of which are described in regards to FIG. 3. The process continues at block 250, where the group of numbers 180 is displayed in user interface element 170.

FIG. 3 illustrates an exemplary code snippet that implements an embodiment of a process for generating a group of numbers 180 suitable for use as lottery selections. At line 300, an array iGroupOfNums is initialized which is to contain the group of numbers 180 suitable for use as lottery selections. Also in line 300, iNumberOfTickets will contain the information from user interface element 130 and iBallsperTicket will contain the information from user interface element 120. Referring to the example of FIG. 1, line 300 will initialize the iGroupOfNums array with eight rows and six columns. In line 301, N will contain the information from user interface element 110 which in the example of FIG. 1 will have N as forty-nine. Also in line 301 an array iOccurrencesInGroupOfNums is initialized with fifty elements, zero through forty-nine. This array will contain the number of occurrences of each number in the group of numbers 180. In line 302, an integer variable S is initialized to the number of distinct numbers that can go into the group of numbers 180. In line 302 iExcludes is an integer array holding the information from user interface element 140. Referring to the example of FIG. 1, line 302 will have iExcludes.Length as seven, so S will be assigned forty-two. Line 303 initializes an object that will be used to generate random numbers.

Line 304 is the start of a loop that loops through the number of tickets, which from the example in FIG. 1 would be eight tickets. Line 305 initializes an array that keeps track of the occurrences of numbers within a particular ticket (a particular row in the array holding the group of numbers 180). Line 306 is the start of a loop that loops through all the numbers that need to be generated for a particular ticket. Line 307 initializes a flag that signals that the current number must be rejected and a new number must be generated. Line 308 is the start of a do loop that generates a number and then checks it to make sure it is acceptable for the group of numbers 180 which is held in the array iGroupOfNums. Line 310 generates a random integer between one and N, which from the example of FIG. 1, would have line 310 generate a random integer between one and forty-nine and put it in the group of numbers 180. Lines 311 and 312 check to make sure the number has not already been used in the row, raising the rejection flag if it has been used within the row.

Line 313 checks to make sure the number has not been used too often already in the group of numbers 180. Keep in mind in line 313 uses integers, so the division will be truncated. Using FIG. 1 information, S was determined to be forty-two (seven numbers have been excluded from the population of forty-nine), so every time forty-two numbers are generated and accepted, line 313 will allow another occurrence for each number in the group of numbers 180. The affect of line 313 is that even though the numbers are generated randomly, all numbers that are eligible to go into the group of numbers 180 must be used up before an additional occurrence of any particular number is allowed. This produces a reasonably flat distribution of numbers within the group of numbers 180, even if the group of numbers 180 is quite small, such as five to ten rows.

Lines 315, 316, and 317 check to make sure the generated number does not belong to the set of excluded numbers. If the generated number is accepted, the occurrence arrays are updated in lines 319 and 320.

FIG. 4 illustrates an example run through the code of FIG. 3 using the information of FIG. 1. The resulting group of numbers 180 is displayed in the user interface element 170 and the occurrence array 400 (corresponding to iOccurrencesInGroupOfNums[ ]) is shown. Recall from FIGS. 1 and 3, that for this example N is forty-nine and that the set of numbers {1, 2, 3, 30, 47, 48, 49}, user interface element 140, has been excluded from the group of numbers 180. The number of tickets has been selected as eight, user interface element 130 and there are six numbers per ticket, user interface element 120. Therefore the group of numbers 180 will have forty-eight numbers. The number of eligible numbers is forty-two (forty-nine minus seven excludes) so the group of numbers 180 will have forty-two numbers occurring once and six numbers occurring twice. The affect of line 313 from FIG. 3 can be seen in the group of numbers 180 displayed in the user interface element 170 of FIG. 4, the smallest number of occurrences is one and the largest number of occurrences is two.

The date in user interface element 150 can be used to affect the resulting group of numbers 180 by simply adjusting the time when the random number generation is invoked in a way that is associated with the particular date in the user interface element 150. For example, there could be a delay before the random number is generated, where the delay is dependent on the date selected in the user interface element 150. A number corresponding to the date can be used to seed the random number generator function. Other ways to have a date affect the generation of a group of numbers 180 are of course possible.

While various embodiments have been described above, it should be understood that it has been presented by way of example only, and not limitation. The process described above can be implemented in hardware, the process does not require a set of numbers to exclude from the group of numbers 180 and the date dependency is not a requirement for the number generation. The group of numbers 180 shown in FIG. 1 and FIG. 4 is only one example of a group of numbers 180. The group of numbers 180 can comprise different numbers than those illustrated. Computer executable instructions for carrying out the method for generating a group of numbers 180 usable as selections for a lottery may be stored on any suitable media readable by a computer such as floppy disks, hard disks, CD-ROMS, DVDs, Flash ROMs, non-volatile ROM and RAM. Many alternative embodiments are possible.

I claim:

1. A non-transitory computer readable medium having computer-executable instructions for allowing exclusion criteria to be applied in the display of lottery selections with a graphical user interface ("GUI"), the computer-executable instructions implementing steps comprising:

displaying, via the GUI, a first user interface element configured to receive a user's indication of a top number, wherein the top number corresponds to the highest number that can be drawn in a lottery;

displaying, via the GUI, a second user interface element configured to accept the user's entry of a set of exclusion numbers, wherein the set of exclusion numbers contains at least two numbers and wherein each number in the set of exclusion numbers is less than or equal to the top number;

displaying, via the GUI, a third user interface element configured to accept the user's entry of a date, wherein the date consists of the user's birthdate or anniversary date;

receiving, via the GUI, an indication from the user to generate a set of lottery numbers, wherein the set of lottery numbers contains at least two numbers;

in response to receiving the indication to generate the set of lottery numbers, receiving the top number from the first user interface element, subsequently receiving the set of exclusion numbers from the second user interface element, and receiving the date from the third user interface element;

generating a random number based on the date;

adding the random number to the set of lottery numbers if the random number satisfies a first constraint on the set of lottery numbers and wherein the first constraint on the set of lottery numbers is that no number in the set of lottery numbers is in the set of exclusion numbers;

repeating, at least once, the steps of generating the random number based on the date and adding the random number to the set of lottery numbers if the random number satisfies the first constraint on the set of lottery numbers; and displaying, via the GUI, the set of lottery numbers.

* * * * *